US007347924B1

(12) United States Patent
Yoon

(10) Patent No.: US 7,347,924 B1
(45) Date of Patent: Mar. 25, 2008

(54) ANODIZING OF OPTICALLY TRANSMISSIVE SUBSTRATE

(75) Inventor: Ick Jhin Yoon, Irvine, CA (US)

(73) Assignee: IJ Research, Inc., Santa Ana, CA (US)

( * ) Notice: Subject to any disclaimer, the term of this patent is extended or adjusted under 35 U.S.C. 154(b) by 366 days.

(21) Appl. No.: 10/745,929

(22) Filed: Dec. 24, 2003

Related U.S. Application Data

(60) Provisional application No. 60/436,436, filed on Dec. 24, 2002.

(51) Int. Cl.
*C25D 5/02* (2006.01)
*C25D 7/00* (2006.01)

(52) U.S. Cl. ..... 205/171; 205/333

(58) Field of Classification Search ..... 205/170, 205/171, 172, 173, 316, 324, 325, 323, 333; 204/192.1
See application file for complete search history.

(56) References Cited

U.S. PATENT DOCUMENTS 4,681,666 A * 7/1987 Potter et al. ..... 205/118
5,240,868 A * 8/1993 Bae et al. ..... 438/591
5,397,719 A * 3/1995 Kim et al. ..... 438/30
5,643,817 A * 7/1997 Kim et al. ..... 205/124
2003/0175472 A1* 9/2003 Den et al. ..... 428/66.6
2004/0096617 A1* 5/2004 Yoo et al. ..... 428/64.1

FOREIGN PATENT DOCUMENTS

JP 63-124003 * 5/1988
JP 06-301063 * 10/1994
JP 08-306698 * 11/1996

* cited by examiner

*Primary Examiner*—Michael E. Lavilla
(74) *Attorney, Agent, or Firm*—Law Office of Glenn R. Smith; Glenn R. Smith; Lei Liu

(57) ABSTRACT

Metallization is disposed on at least a portion of an electrically nonconductive substrate. Plating is then disposed on the metallization, and an anodized layer of the plating is configured to provide the substrate with an anodized surface. The substrate may be glass or ceramic, and in particular sapphire. The substrate may be optically transmissive, and the metallization and plating may define a window adapted to transmit light through the substrate.

3 Claims, 4 Drawing Sheets

DETAIL "A"

ANODIZING OF OPTICALLY TRANSMISSIVE SUBSTRATE

CROSS-REFERENCE TO RELATED APPLICATIONS

This application relates to and claims the benefit of prior U.S. Provisional Application No. 60/436,436 entitled Inorganic Coating filed Dec. 24, 2002 and incorporated by reference herein.

BACKGROUND OF THE INVENTION

Anodizing is an electrochemical process which grows a dense oxide layer on certain metals, including aluminum, niobium, tantalum, titanium and tungsten. The thickness of this layer and its properties vary greatly depending on the metal. For example, the anodizing process converts an aluminum surface into an extremely hard, durable, corrosion resistant, long-lasting aluminum oxide, which has diverse and important applications. Further, this surface can be processed to have a variety of colors as well as finishes, such as reflective or matte.

SUMMARY OF THE INVENTION

Applications, such as those involving high definition television (HDTV), lasers and high-power illumination are problematic for some component parts and associated coatings, particularly those coatings colored with organic materials or dyes. Such organic coatings can easily be destroyed, damaged or degraded by resulting high temperatures associated with these applications. By comparison, anodizing provides an inorganic coating that can withstand high temperatures without degradation. Conventional anodization, however, is limited to certain metals. Anodizing of electrically non-conductive materials, such as glass or ceramic, advantageously provides an inorganic coating suitable for high temperature applications on the surface of materials readily adapted to a wide range of both optical and non-optical applications.

One aspect of an anodized apparatus comprises an electrically nonconductive substrate, a metallization disposed on at least a portion of the substrate, a plating disposed on the metallization, and an anodized layer of the plating configured to provide the substrate with an anodized surface. In one embodiment, the substrate is glass or ceramic, and in a particular embodiment, the substrate is sapphire. In another embodiment, the substrate is optically transmissive, and the metallization and plating define a window adapted to transmit light through the substrate. In a particular embodiment, the anodized layer has a matte black finish. In yet another embodiment, the metallization comprises an adhesion layer disposed on at least a portion of the substrate and a diffusion barrier disposed on the adhesion layer. In a particular embodiment, the plating is aluminum, the adhesion layer is chromium and the diffusion barrier is nickel.

An aspect of an anodizing method comprises the steps of providing an electrically nonconductive substrate, depositing a metallization on at least a portion of the substrate, depositing a plating on the metallization and anodizing the plating. The anodizing method may comprise a further step of defining an aperture with the metallization and the plating, where the aperture provides a window for transmitting light through the substrate. Coloring a surface of the plating and finishing the surface may be additional steps. In one embodiment, the providing a substrate step comprises the substep of adapting the substrate as an optical component. In another embodiment, the metallization step comprises the substeps of depositing an adhesion layer on at least a portion of the substrate and depositing a diffusion barrier on the adhesion layer. The adhesion layer step may comprise the substep of sputtering chromium onto the substrate. The diffusion barrier step may comprise the substep of sputtering nickel onto the chromium. A further step may include sputtering gold onto the nickel. Yet another step may comprise masking the substrate so as to form an unmetallized area. The plating step may comprise the substep of electroplating aluminum onto the metallization.

Another aspect of an anodized apparatus comprises a substrate means for transmitting light, a plating means for anodization, and a metallization means disposed on the substrate means for adhering the plating means to the substrate means. In one embodiment, the apparatus further comprises an anodized layer means anodized from the plating means for absorbing light and withstanding high temperatures without degradation. There may also be a window means for transmitting light through the substrate, which is defined by the plating means and the metallization means, where the anodized layer means is disposed around the window means.

DETAILED DESCRIPTION OF THE PREFERRED EMBODIMENTS

Figure 1:
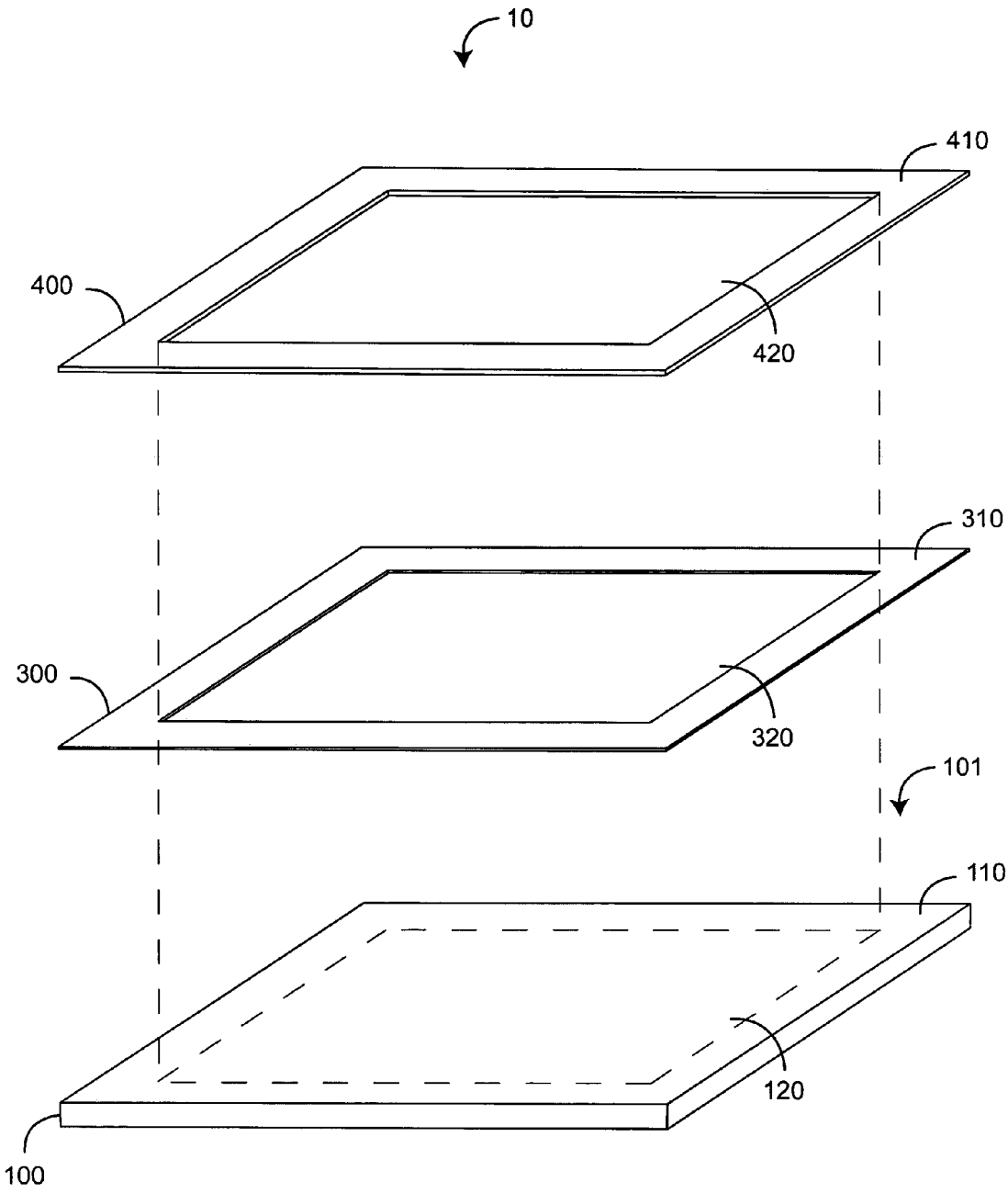
FIG. 1 is an exploded perspective view of an anodized electrically non-conductive substrate.

FIG. 1 illustrates an anodized electrically non-conductive substrate 10 having a blank substrate 100, a metallization 300 and a plating 400. Advantageously, the blank substrate 100 need not be aluminum or metal in order to be anodized and achieve the hard, durable finish associated with anodization. The blank substrate 100 has a surface to be anodized 101, including an anodized area 110 and, optionally, a non-anodized area 120. In one particularly useful embodiment, the blank substrate 100 is transparent or translucent so that the non-anodized area 120 provides a window or lens that transmits light and so that the anodized area 110 blocks, absorbs and/or reflects light. As such, the anodized substrate 10 can be used in optical or opto-electrical applications, where the anodized coating is capable of withstanding high temperatures without degradation.

Further shown in FIG. 1, the metallization 300 has a metallized area 310 corresponding to the anodized area 110 and an unmetallized area 320 defining an aperture and corresponding to the non-anodized area 120. Similarly, the plating 400 has a plated area 410 corresponding to the anodized area 110 and an unplated area 420 defining an aperture and corresponding to the non-anodized area 120. An anodizing process for electrically non-conductive material is described with respect to FIG. 2, below. The metallization 300 is described in detail with respect to FIG. 3, below. The plating 400 is described in detail with respect to FIG. 4, below.

Figure 2:
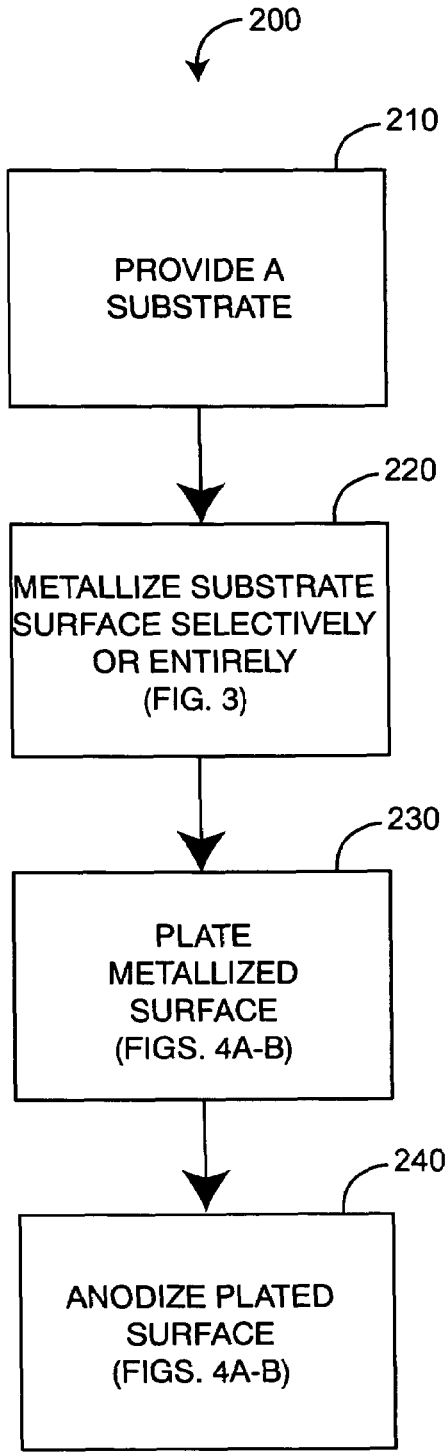
FIG. 2 is a flow diagram of an anodizing process for an electrically non-conductive substrate.

FIG. 2 illustrates an anodization process 200 having the steps of providing a substrate 210, metallizing the substrate surface 220, plating the metallized surface 230, and anodizing the plated surface 240. With respect to the providing a substrate step 210, the substrate is an electrically non-conductive material as distinguished from the metals conventionally associated with anodization. In one embodiment, the substrate 100 (FIG. 1) is any of various glass or ceramic materials having transparent, translucent or opaque characteristics. In a particularly advantageous embodiment, the substrate is sapphire, which can be optically transmissive and can provide superior high temperature characteristics as compared to glass.

Figure 3:
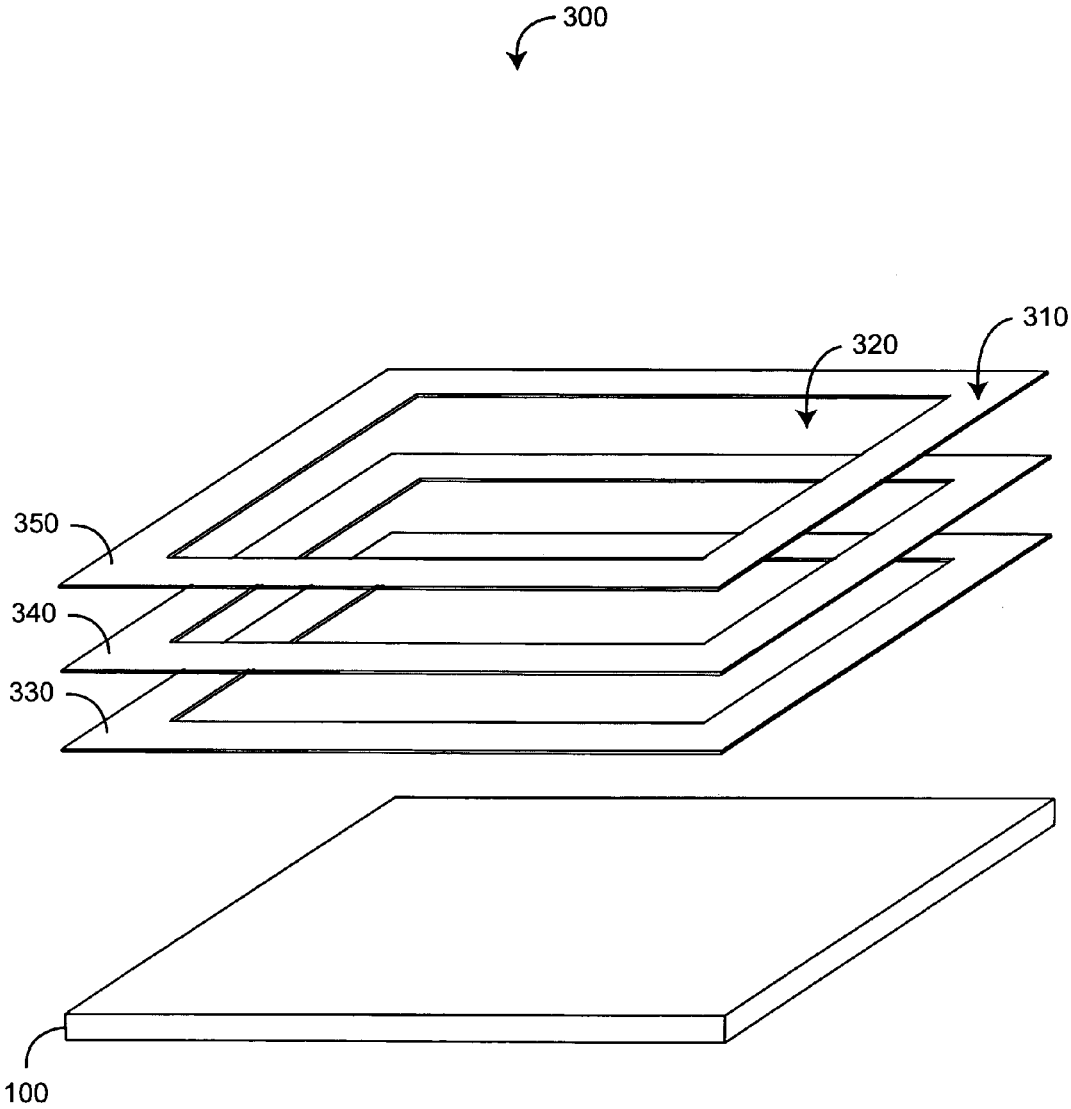
FIG. 3 is an exploded perspective view of a metallization.

As shown in FIG. 2, the metallizing step 220 utilizes a thin-film process to apply the metallization 300 (FIG. 3) to the blank substrate 100. The metallization 300 (FIG. 3) advantageously allows the plating 400 (FIG. 4A) to be disposed on a variety of substrate materials, as described above. Metallizing 220 has the substeps of depositing an adhesion layer 330 (FIG. 3), depositing a diffusion barrier 340 (FIG. 3) and depositing an optional layer 350 (FIG. 3). If the anodized substrate 10 (FIG. 1) is to have a non-anodized area 120 (FIG. 1), then a masking or etching substep is applied before or after the depositing substeps. The plating step 230 provides a coating of "anodizable" metal over the metallization 300 (FIG. 3). It is this plating 400 (FIG. 4A) that advantageously provides a surface that allows the anodizing step 240. Metallizing 220 is described in detail with respect to FIG. 3, below. The plating 230 and anodizing 240 are described in detail with respect to FIGS. 4A-B, below.

FIG. 3 illustrates a metallization 300 having a metallized area 310 and an optional unmetallized area 320, as described above. The metallization 300 also has an adhesion layer 330, a diffusion barrier 340 and an optional layer 350, as described below. In one embodiment, the adhesion layer 330 is Cr, Ti, W, Ti/W, or Ni/V having a thickness up to about 3,500 Å. In one embodiment, Ti, W or Ti/W are used on most ceramics, including sapphire, Cr is used on all glass materials, and Ni/V is used for both glass and ceramics. The end results are approximately the same for these metals/alloys in terms of adhesion and subsequent processing. In one embodiment, the diffusion barrier 340 is Ni having a thickness up to about 10,000 Å. In one embodiment, the optional layer 350 is Au having a thickness up to about 4,000 Å.

As shown in FIG. 3, the metallization 300 is applied to the blank substrate 100 (FIG. 1) using any of three thin film technologies, including sputtering, chemical vapor deposition (CVD) or vacuum evaporation, although the integrity of the metallization adhesion to the substrate can be lower with CVD and evaporation than that achieved by sputtering. In a particular embodiment, an RF sputter is used with the process parameters set forth in Table 1, below.

TABLE 1

| Metallization Process Parameters | |
|---|---|
| Hi Vacuum System | Minimum vacuum level $7 \times 10^{-7}$ torr-the lower the better. |
| Process Atmosphere | Argon (99.999%) at chamber pressure of between 10-12 millitorr |
| RF Sputter | 500 W for each of Cr (99.99%); Ni (99.995%), Au (99.99%) |
| Process Time | Cr: 5-10 minutes @ 300-350 Å/min.<br>Ni: 10-20 minutes @ 400-500 Å/min.<br>Au: 2-4 minutes @ 1000 Å/min. |

TABLE 1-continued

| Metallization Process Parameters | |
|---|---|
| Target-to-substrate distance | 3.5-4.0 inches |
| Reflectance power | At or near 0 W during all runs and constantly adjusted if needed. |
| Other: | Ensure that substrate does not overheat.<br>Ensure that the chamber pressure is maintained between 10-12 millitorr during sputtering |

Figure 4A:
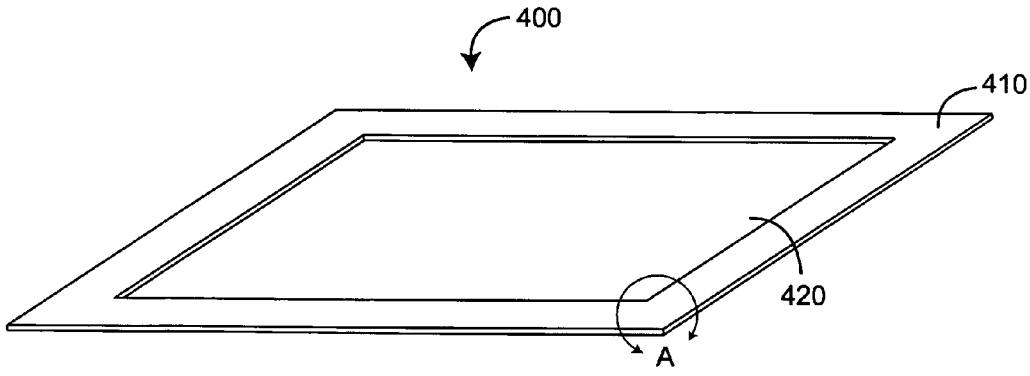
FIGS. 4A-B are perspective and detailed perspective views, respectively, of a plating.
Figure 4B:
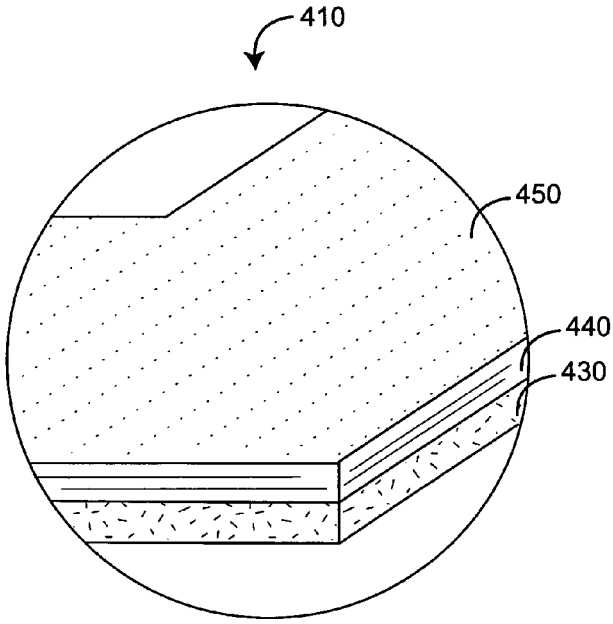

FIGS. 4A-B illustrate a plating 400 having a plated area 410 and an optional unplated area 420, as described above. As shown in FIG. 4B, the plating 400 also has an unanodized layer 430, an anodized layer 440, and an anodized surface 450, as described below. The plating 400 is applied to the metallization 300 (FIG. 3), as described below, so as to provide an anodized surface 450 for electrically non-conductive materials. The plating thickness is configured to be as thin as possible so as to be most compatible with high temperature applications, yet configured to have sufficient thickness for the anodization process, which converts portions of the plated layer 400 to the anodized layer 440, with the unanodized layer 430 remaining. The plating may be any metal that can be anodized, such as those listed above. In one embodiment, the plating 400 is Al or Ti, either having a thickness up to about 0.002 inches.

Further shown in FIG. 4B, for Al, the plating 400 is applied by an electro-plating process, a sputtering process, or a combination of electro-plating and sputtering, which are well-known processes in the art. In an alternative embodiment, the plating 400 is applied by chemical vapor deposition (CVD), plasma coating, vacuum evaporation or other vacuum coating technique in lieu of sputtering, although the adhesion strength to the metallization 300 (FIG. 3) will be lower. For Ti, the plating 400 is applied by sputtering, CVD, plasma coating, vacuum evaporation or other vacuum coating technique. For Ti, however, advantageously there is no need for metallization 300 (FIG. 3) or the metallizing process 220 (FIG. 2) prior to the plating process 230 (FIG. 2). Unlike Al, Ti has sufficient adherence to glass, ceramic or other electrically nonconductive substrates for the plating 400 to be deposited directly onto the substrate 100 (FIG. 1).

In a particular embodiment, the plated layer 220 is electro-plated aluminum, which can be applied by a vendor such as Alumiplate, Inc., Minneapolis, Minn. The anodized surface 450 can be given a matte or reflective finish by pre-treatment with etching or smoothing solutions, respectively. The anodized surface 450 can also be colored either integrally with the anodizing process or by electrolytic immersion in a metal salt. In a particular embodiment, the anodized surface 450 is colored black.

Although an anodized apparatus and anodizing method are described above with respect to a generally flat substrate, the term substrate is intended to denote materials, components and assemblies having any shape or size. Further, although metallization and plating are described above as being applied on an apparently outside or exposed surface of a substrate, the anodizing method is applicable to inside or unexposed surfaces of components or assembles. In addition, although specific mention is made of glass and ceramic materials, the anodizing method is applicable to polymers and other electrically non-conductive materials as well as metals and metal alloys not conventionally associated with anodization.

An anodized apparatus and an anodizing method have been disclosed in detail in connection with various embodiments. These embodiments are disclosed by way of examples only and are not to limit the scope of the claims that follow. One of ordinary skill in art will appreciate many variations and modifications.

What is claimed is:

1. An anodizing method comprising the steps of:

providing an optically transmissive substrate;

defining an uncoated portion of said substrate for transmitting light through said substrate; and forming an anodized coated portion of said substrate around said uncoated portion for blocking light from said substrate, wherein said forming step comprises the substeps of:

masking only said uncoated portion of said substrate;

depositing a metallization on said substrate around said mask;

plating said metallization; and anodizing said plating.

2. The anodizing method according to claim 1 wherein said depositing a metallization step comprises the substeps of:

depositing an adhesion layer on at least a portion of said substrate so as to provide sufficient adherence of said plating to said substrate; and depositing a diffusion barrier on said adhesion layer.

3. The anodizing method according to claim 2 comprising the further steps of:

treating said plating so that said anodizing step provides a matte or reflective finish; and coloring said anodization.

* * * * *